United States Patent [19]

Sundheimer et al.

[11] Patent Number: 4,917,146

[45] Date of Patent: Apr. 17, 1990

[54] FLUID DISTRIBUTOR IN A PRESSURIZED RESERVOIR PREVENTING THERMAL STRATIFICATION

[75] Inventors: Patrick Sundheimer, Saint Maur des Fosses; Yves Pascal, Nanterre, both of France

[73] Assignee: Framatome, Courbevoie, France

[21] Appl. No.: 248,667

[22] Filed: Sep. 26, 1988

[30] Foreign Application Priority Data

Sep. 25, 1987 [FR] France ..... 87 13296

[51] Int. Cl.[4] ..... F22B 37/12

[52] U.S. Cl. ..... 137/561 A; 137/561 R

[58] Field of Search ..... 137/561 R, 561 A; 122/383, 451 R, 456

[56] References Cited

U.S. PATENT DOCUMENTS

| | | | |
|---|---|---|---|
| 2,164,011 | 6/1939 | Hilborn | 137/561 A X |
| 2,168,404 | 8/1939 | Grant | 137/561 A X |
| 3,141,000 | 7/1964 | Turner | 137/561 R X |
| 3,785,625 | 1/1974 | Engalitcheff, Jr. | 261/29 |
| 4,060,057 | 11/1977 | Carteus et al. | 122/451 R |
| 4,302,338 | 11/1981 | Pfohl et al. | 137/561 A X |
| 4,320,072 | 3/1982 | Arndt | 261/111 |
| 4,505,231 | 3/1985 | Syler | 122/383 X |
| 4,561,461 | 12/1985 | Hubert et al. | 137/561 A |
| 4,566,406 | 1/1986 | Appleman | 122/383 X |

FOREIGN PATENT DOCUMENTS

| | | |
|---|---|---|
| 1144087 | 3/1969 | United Kingdom . |
| 2065500 | 7/1981 | United Kingdom . |

*Primary Examiner*—John Rivell

*Attorney, Agent, or Firm*—Pollock, Vande Sande & Priddy

[57] ABSTRACT

Cold water introduced with a low flow rate into a duct filled with hot water normally circulates in the bottom thereof and accumulates at its end. It is discharged only at the end of the distributor where its pressure is highest. The immiscible hot water is located elsewhere and high thermal stresses appear on the distributor at the interface between two layers. This problem is solved by providing the distributing tubes (2) or the actual duct (1) with cuts (6 and 9) in particular favoring the upstream flow.

5 Claims, 2 Drawing Sheets

FLUID DISTRIBUTOR IN A PRESSURIZED RESERVOIR PREVENTING THERMAL STRATIFICATION

FIELD OF THE INVENTION

The present invention relates to a fluid distributor in a pressurized reservoir preventing thermal stratification in said distributor between two fluid layers immiscible at different temperatures. It can in particular apply to a device for supplying water to steam generators for nuclear power stations.

BACKGROUND OF THE INVENTION

The water constituting the secondary fluid of heat exchangers of nuclear power stations is vaporized in a steam generator, whose wall is penetrated by a water supply pipe. This pipe is terminated by a horizontal toroidal distributor extending externally along the cylindrical wall of the steam generator. The interior of the steam generator and the interior of the torus communicate with the aid of distribution tubes traversing the wall of the latter and located on its upper generatrix. Relatively frequently these tubes are crook-shaped, i.e., the end thereof outside the torus terminates in a circular arc which is radially oriented with respect to the torus. Depending on the particular case, the other end of the tubes penetrates the torus, possibly up the approximately the center of its section, or is simply flush with the inner surface of its wall. The latter construction is essential if the torus is completed by a tubular connecting section, which is fitted into the supply tube during assembly.

Such distributors assist uniform water flow in the steam generator, ensure that the supply water undergoes pressure drops limiting the turbulence of its flow and in particular, in the case of lowering the liquid level in the steam generator, prevent draining of the pipes which would result in water hammer.

Such an arrangement prevents this phenomenon, but does not prevent the possible appearance of thermal stratification under certain exceptional operating conditions of the steam generator.

Under transient or accidental operating conditions, it may be necessary to supply the steam generator with cold water at a very low flow rate. It is then found that this water, which has a higher density than the hot water which previously flowed in the distributor, does not mix with the latter and circulates in the bottom of the supply pipe and the torus. The hot water remaining at the top of the water supply pipe and the torus is replenished as a result of convection currents with the hot water outside the torus and consequently remains at high temperature. This hot water is only discharged in that part of the torus diametrically opposite to the supply pipe, where the two cold air streams join again, which increases their pressure. The cold water level locally rises opposite to the entrance into the torus until it reaches and fills the distribution tube located at this point and then the cold water passes into the steam generator. However, this phenomenon remains local and there is always an interface between the two superimposed water layers. This interface corresponds to a thermal level which can exceed 100° C. in said pressurized water. The walls of the torus and the supply pipe are therefore exposed to very high stress concentrations at these points, which are made more dangerous by the fact that they work in fatigue. Fractures have been noted at the point where the supply pipe traverses the envelope of the steam generator and is welded thereto. The metal there is already subject to internal stresses and has less scope for deforming.

SUMMARY OF THE INVENTION

The invention eliminates these disadvantages and consists of inducing the flow of water outside the distribution torus into areas closest to the supply pipe, where the hot water is likely to accumulate. Under operating conditions where the cold water flow supplying the torus is low, the invention makes it possible to limit the pressure losses produced by the traversal of the distribution tubes mainly in areas where the hot water tends to accumulate. Thus, there is a much more balanced flow in the different tubes, and the hot water is completely discharged. The invention applies not only to a distribution device incorporating a single supply pipe connected to a torus, but also to any equivalent device having a substantially horizontal duct in the steam generator equipped with distribution tubes traversing it by its upper generatrix.

More specifically, the invention relates to a fluid distributor in a pressurized reservoir having a fluid supply pipe penetrating the reservoir and terminated by a substantially horizontal, tubular distributing portion communicating with the interior of the reservoir by tubes traversing its upper generatrix, characterized in that the tubes have a wall which is cut outside the distributing portion.

The invention can be realized in two main modes, namely, the wall of the tubes can have pierced openings or, if said tubes are crooked, the lower surface thereof can be cut.

In an important embodiment of the invention, the tube cuts are at increasing heights in the direction away from the water supply pipe.

The invention can also be realized if the distributing portion is provided with openings or cuts on its upper generatrix between the tubes and the supply pipe.

BRIEF DESCRIPTION OF THE DRAWINGS

The invention is described in greater detail hereinafter relative to several embodiments illustrated in the attached drawings, wherein.

DESCRIPTION OF PREFERRED EMBODIMENTS

Figure 1:
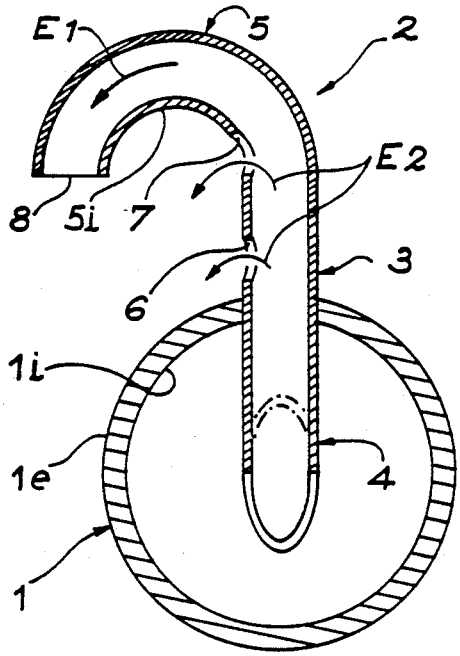
FIG. 1 and 1*a* show a first embodiment of the invention in sectional front and side view, respectively.
Figure 1A:
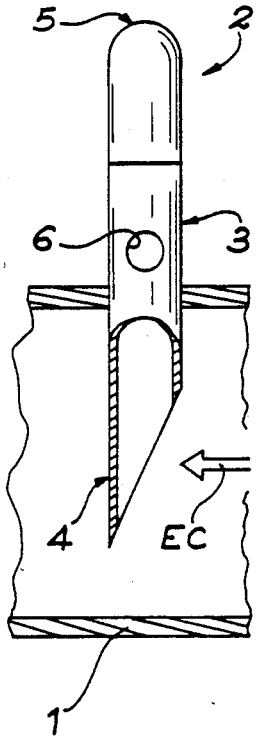

FIGS. 1 and 1*a* show a duct 1, viewed in section, which can have a toroidal shape and which is located within a steam generator, whose envelope is traversed by a supply pipe, which supplies duct 1 with water. Duct 1 is horizontal and is provided with distributing tubes 2 (only one of which is shown,) which are generally vertical and which traverse the wall of duct 1 at its upper generatrix. Part of the water flowing in duct 1 consequently passes into distributing tube 2 and leads to the interior of the steam generator. The distributing tube 2 shown here can be broken down into three parts, namely a rectilinear median part 3, welded to duct 1 and traversing the latter, flush at a first end with the inner surface 1i of the wall of duct 1 and extending outside its outer surface 1e into the interior of the steam generator: a first end part 4 connected to the first end of the median part 3 which it extends by extending into duct 1; and a second end part 5 connected to the other end of the median part 3, located outside duct 1 and in semicircular or crook-form oriented radially with respect to duct 1.

The first end part 4 is bevelled at the end, as can be better seen in FIG. 1*a*, The water flow direction in duct 1 is indicated by arrow Ec. The bevel arrangement makes it possible to introduce part of the fine streams of water into the distributing tube 2 and to thus favor their flow therethrough. In the construction shown, the upper part of the bevel, oriented upstream of flow Ec, is approximately three-quarters of the height of duct 1 and the lower part of the bevel, downstream of flow Ec, is approximately one-quarter of this height.

The proportions of the distributing tubes can be significantly modified, especially as regards their end parts 4 and 5, which are not essential and which can be completely eliminated.

According to the FIG. 1 embodiment of the invention, distributing tube 2 is cut outside duct 1 by one or more piercing openings. In the example shown, there are two such openings, a lower opening 6 on median part 3 and an upper opening 7 on the second end part or crook 5. The number and arrangement of these openings can vary and their angular arrangement on the circumference of the distributing tube 2 is arbitrary.

The operation of the distributor with the aid of such distributing tubes 2 will now be described. During the normal operation of the steam generator, hot water circulates at a high flow rate in duct 1. Part of the water passes into each of the distributing tubes 2 in the direction of arrow E1. The pressure of the supply water is adequate to cause it to rise up to crook 5 and finally to flow through the free end 8 thereof into steam generator. However, when the steam generator is supplied with a limited cold water flow, things are completely different. The cold water generally has a low hydraulic pressure, except at the end of the torus opposite to the supply pipe, where it accumulates and finally acquires a adequate pressure to entirely penetrate the distributing tubes 2 at this point and flow into the steam generator. In the parts located upstream of the flow, the pressure remains at a lower value, which does not enable the water to pass into crooks 5. However, this pressure is adequate to cause the hot water be gradually discharged through openings 6 and 7, so that finally the cold water fills duct 1 and penetrates the distributing tube 2, followed by flowing through said same openings 6, 7 in the direction of arrows E2. Thus, the interface between the hot water and the cold water in duct 1 is progressively eliminated, so that there is no abnormal stress concentration along its wall.

Figure 2:
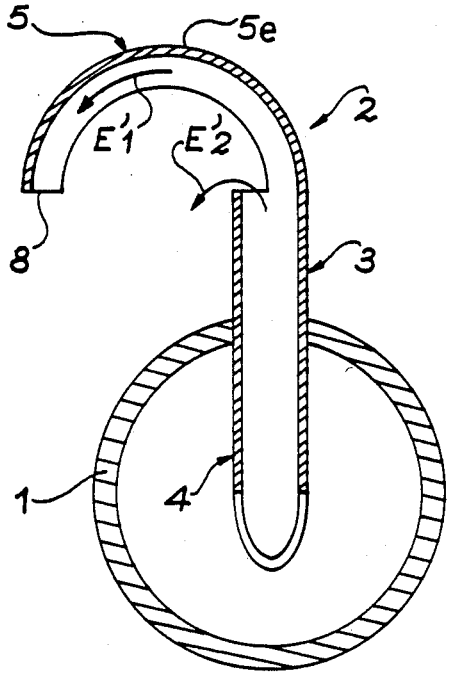
FIG. 2 shows a second embodiment of the invention.

Another embodiment of the invention is illustrated in FIG. 2. In this case, there are no pierced openings. Instead, the lower surface 5*i* (FIG. 1) of crook 5 has been removed over its entire length, i.e., the section of crook 5 is then open in its lower part.

The operation of this embodiment is very similar to that of the first embodiment. Under normal operating conditions, hot water at a high pressure is channelled by the upper surface 5*e* of crook 5, is progressively directed downwards and in the transverse direction with respect to duct 1 and finally joins the water present in the steam generator at the free end 8 of crook 5. In the case of a low cold water flow rate, the water progressively rises into the media part 3 (and possibly the first end part 4 if the latter exists) of supply tube 2 and is finally flush with the top of the median part 3 and flows out of the supply tube 2 by way of the cut part of the lower surface of crook 5. Arrows E'1 and E'2 show the directions of these two different flows.

Figure 3:
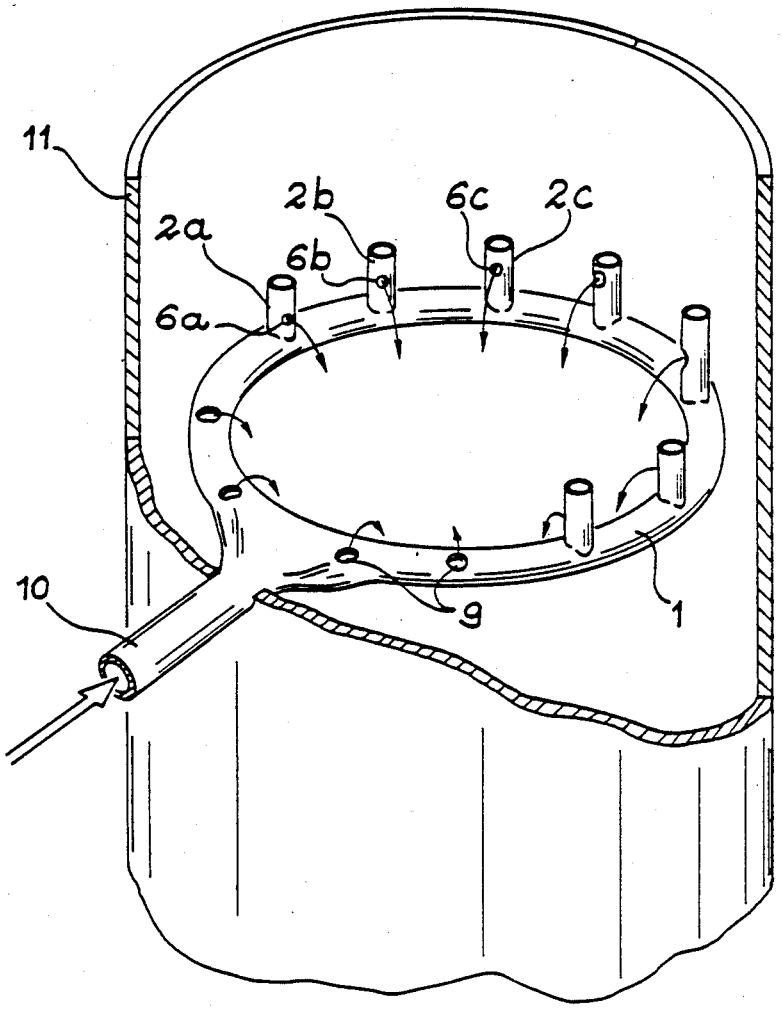
FIG. 3 shows the invention in place on a complete supply torus.

Preferably all these cuts made on the distributing tubes 2 differ as a function of the location of said tubes 2 along duct 1. FIG. 3 shows a complete supply device incorporating a toroidal duct 1 connected to a supply pipe 10 traversing the envelope 11 of a steam generator to which it is welded. Duct 1 can be welded to supply pipe 10 or can be provided with a coupling fitted into pipe 10.

Thus, the supply water enters the duct 1 and in two symmetrical flows passes through the left and right-hand branches of the torus. The flows successively pass in the vicinity of several distributing tubes 2*a*, 2*b*, 2*c*, etc. from the upstream to the downstream side. Since, for reasons explained hereinbefore, the cold water pressure decreases significantly towards the upstream side in the case of a low flow rate, it is essential to assist the flow out of duct 1, especially in the upstream parts, by more significantly reducing there the pressure losses produced by clearing the entire length of the distributing tubes 2. It is for this reason that the openings 6*a*, 6*b*, 6*c*, etc. on the corresponding distributing tubes 2*a*, 2*b*, 2*c*, etc. are located at decreasing heights on upstream tubes. It is also possible to have openings 9 on the upper generatrix of duct 1 between the most upstream tube 2*a* and the flow pipe 10. The latter arrangement is even necessary in the case of distributing tubes 2 having a first end part 4 extending within duct 1, because it is not then possible to prevent part of the hot water from remaining trapped in the upper part of the duct.

FIG. 3 shows distributing tubes 2 without any crook 5. The result would be the same if they had one, and the invention could be realized in exactly the same way, but with the difference that it would be possible to place tubes 2 with a cut crook such as those shown in FIG. 2 close to the downstream part of the flow (part of the torus diametrically opposite to supply pipe 10).

For a specific realization of the invention, it is advisable to stagger the heights of openings 6*a*, 6*b*, 6*c*, etc. in accordance with a linear law, as a function of curvilinear abscissas of the upper generatrix of the duct 1 on which tubes 2*a*, 2*b*, 2*c*, etc. are fitted.

Thus, the invention makes it possible to obtain in duct 1 a flow and discharge of water much better distributed than with the presently used systems. The cold water with a limited flow rate firstly passes beneath the hot water initially filling the duct 1 and supply pipe 10. The interface formed by these two immiscible water layers is at a substantially constant height over the length of duct 1 and rises progressively until the cold water entirely fills the pipes. Thus, there is no thermal stratification between two very different temperature layers.

What is claimed:

1. Fluid distributor in a pressurized reservoir (11) incorporating a supply pipe (10) for fluid entering the reservoir and terminated by a substantially horizontal distributing part (1) communicating with the interior of the reservoir (11) by tubes (2) passing through an upper generatrix of the distributing part and comprising a circumferential wall terminating in an open end outside the distributing part, the wall being provided with at least one cut between the upper generatrix and the open end.

2. Fluid distributor in a pressurized reservoir according to claim 1, wherein the walls of the tubes are penetrated by pierced openings (6, 7).

3. Fluid distributor in a pressurized reservoir according to claim 1, in which each of said tubes (2) is terminated outside the distributing part by a crook (5), the wall of the tubes (2) being cut on the lower surface of the crooks.

4. Fluid distributor in a pressurized reservoir according to claim 1, wherein the cuts of the tubes (2) increase in height in the direction away from the supply pipe (10).

5. Fluid distributor in a pressurized reservoir according to claim 4, wherein the distributing part (1) is provided with cuts (9) on its upper generatrix between the tubes (2) and the supply pipe (10).

* * * * *